US007640610B2

(12) United States Patent
Mervar

(10) Patent No.: US 7,640,610 B2
(45) Date of Patent: Jan. 5, 2010

(54) UPPER EXTREMITY SUPPORT

(75) Inventor: Perry Mervar, Indianapolis, IN (US)

(73) Assignee: Lante Medical, Inc., Indianapolis, IN (US)

( * ) Notice: Subject to any disclaimer, the term of this patent is extended or adjusted under 35 U.S.C. 154(b) by 0 days.

(21) Appl. No.: 12/180,339

(22) Filed: Jul. 25, 2008

(65) Prior Publication Data

US 2009/0031499 A1 Feb. 5, 2009

Related U.S. Application Data

(60) Provisional application No. 60/962,331, filed on Jul. 27, 2007.

(51) Int. Cl.
*A47C 20/02* (2006.01)

(52) U.S. Cl. ..... 5/647; 5/646

(58) Field of Classification Search ..... 5/632, 5/636, 646–648

See application file for complete search history.

(56) References Cited

U.S. PATENT DOCUMENTS 4,805,605 A * 2/1989 Glassman ..... 602/24
5,125,123 A * 6/1992 Engle ..... 5/648
7,017,215 B1 * 3/2006 Singer et al. ..... 5/646

OTHER PUBLICATIONS

"Material Safety Data Sheet AP1000," Atlantis Plastic Films, Inc., Mankato, MN, 3 pages, Jan. 2, 2007.

* cited by examiner

*Primary Examiner*—Fredricki Conley
(74) *Attorney, Agent, or Firm*—D'Hue Law LLC; Cedric D'Hue

(57) ABSTRACT

A support for use with the upper extremity of a patient is disclosed. An upper extremity support including a wedge for supporting the upper extremity is provided. The upper extremity support may include a block for supporting the wedge. The upper extremity support may also include straps and may define apertures and grooves for fastening and positioning the upper extremity in relation to the upper extremity support, the patient or another support. The upper extremity support may position the upper extremity in a substantially scaption position.

20 Claims, 8 Drawing Sheets

UPPER EXTREMITY SUPPORT

RELATED APPLICATION

This application claims the benefit of U.S. Provisional Application Ser. No. 60/962,331, filed Jul. 27, 2007, the entire disclosure of which is expressly incorporated by reference.

FIELD OF THE INVENTION

The present invention relates to a system and method for supporting the upper extremity of a human, such as a burn patient.

BACKGROUND OF THE INVENTION

As a result of severe burns, a patient can suffer from a reduced range of motion about a joint. Scarring, swelling, and nerve damage may cause this loss of range of motion. In particular, burns formed in the axilla, also known as the armpit, or the gleno-humeral joint, also know as the shoulder, may limit flexion, abduction, and rotational motions of the upper extremities. Furthermore, burns to the chest, shoulder, and upper extremities often result in web like bands of scar tissue. With this condition, and as soft tissue and skin heals, the tissue shortens making it difficult to move the joints near this soft tissue and skin.

Correct positioning of a burned axilla, chest, shoulder and/or upper extremity aids in healing and can reduce loss of range of motion. Proper positioning of the upper extremity assists in reduction of swelling and regaining motion. Care should be exercised when positioning the upper extremity to avoid stress on nerves and vessels. A large bundle of nerves, including the brachial plexus, as well as blood vessels, pass through the axilla or joint to provide nerves (also known as innervate) and supply blood to the upper extremities. The brachial plexus is responsible for cutaneous and muscular innervation of almost the entire upper extremity; therefore, lesions of the plexus can lead to functional impairment, such as loss of touch or pain or other sensory functions.

Positioning the upper extremity away from the rest of the body, also known as abduction, aids in healing. While the upper extremity is abducted, moving the upper extremity toward the front of the body, a form of adduction, also aids in healing.

SUMMARY OF THE INVENTION

According to one aspect of the present invention, an arm support is provided that includes a wedge for use with an upper extremity of a patient. The wedge defines an angle configured for use to abduct or adduct the upper extremity.

According to another aspect of the present invention, another arm support is provided that includes a wedge and a block for use with an upper extremity of a patient. The wedge defines an angle configured for use to abduct or adduct the upper extremity. The block supports the wedge and is configured to horizontally adduct the upper extremity.

According to yet another aspect of the present invention, a method of supporting an upper extremity of a patient is provided that includes the steps of abducting the upper extremity and providing a wedge supporting the upper extremity. The wedge defines an angle positioning the upper extremity.

Additional features of the present invention will become apparent to those skilled in the art upon consideration of the following detailed description of the presently perceived best mode of carrying out the invention.

BRIEF DESCRIPTION OF THE DRAWINGS

The above-mentioned and other features of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The drawings represent embodiments of the present invention, the drawings are to scale, but certain features may be exaggerated in order to better illustrate and explain the present invention.

DESCRIPTION OF THE PREFERRED EMBODIMENTS OF THE INVENTION

The embodiments disclosed below are not intended to be exhaustive or limit the invention to the precise forms disclosed in the following detailed description. Rather, the embodiments are chosen and described so that others skilled in the art may utilize their teachings.

Figure 1:
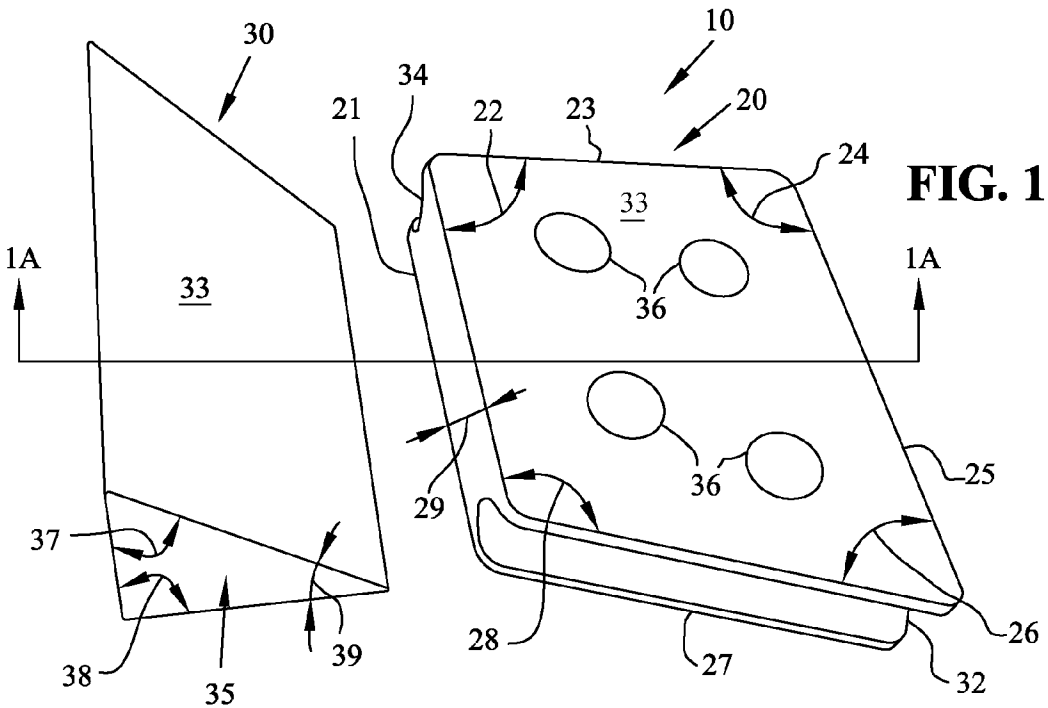
FIG. 1 is a perspective view of an upper extremity support including a wedge and a block.

Referring to FIG. 1, upper extremity support 10 is shown to include wedge 20 and optionally block 30. It is understood that upper extremity support 10 may be a single piece incorporating wedge 20, block 30, or the combination thereof.

According to one embodiment, wedge 20 has a polygon geometry, such as a four sided polygon geometry. As illustrated, wedge 20 defines four sides 21, 23, 25, and 27. In the illustrated embodiment, sides 21, 23, 25, and 27 are different from each other. Illustratively side 23 is substantially twenty (20) inches and side 25 is substantially twenty-four (24) inches. In other embodiments, sides 21, 23, 25, and 27 may be other lengths or similar to each other. Also as illustrated wedge 20 defines a thickness 29. Illustratively thickness is substantially six (6) inches.

Smaller versions of wedge 20 may also be provided for pediatric and youth applications. In a pediatric embodiment, the sizes are approximately cut in half. For example, side 23 is substantially ten (10) inches and side 25 is substantially twelve (12) inches. Thickness 29 is substantially three (3) inches.

As illustrated, wedge 20 defines four angles 22, 24, 26, 28. In the illustrated embodiment, angles 22, 24, 26, 28 are different from each other. Illustratively angle 22 is substantially 85°, angle 24 is substantially 95°, angle 26 is substantially 70°, and angle 28 is substantially 110°. Angles 22, 24, 26, 28 may be other angles or similar to each other.

Figure 6:
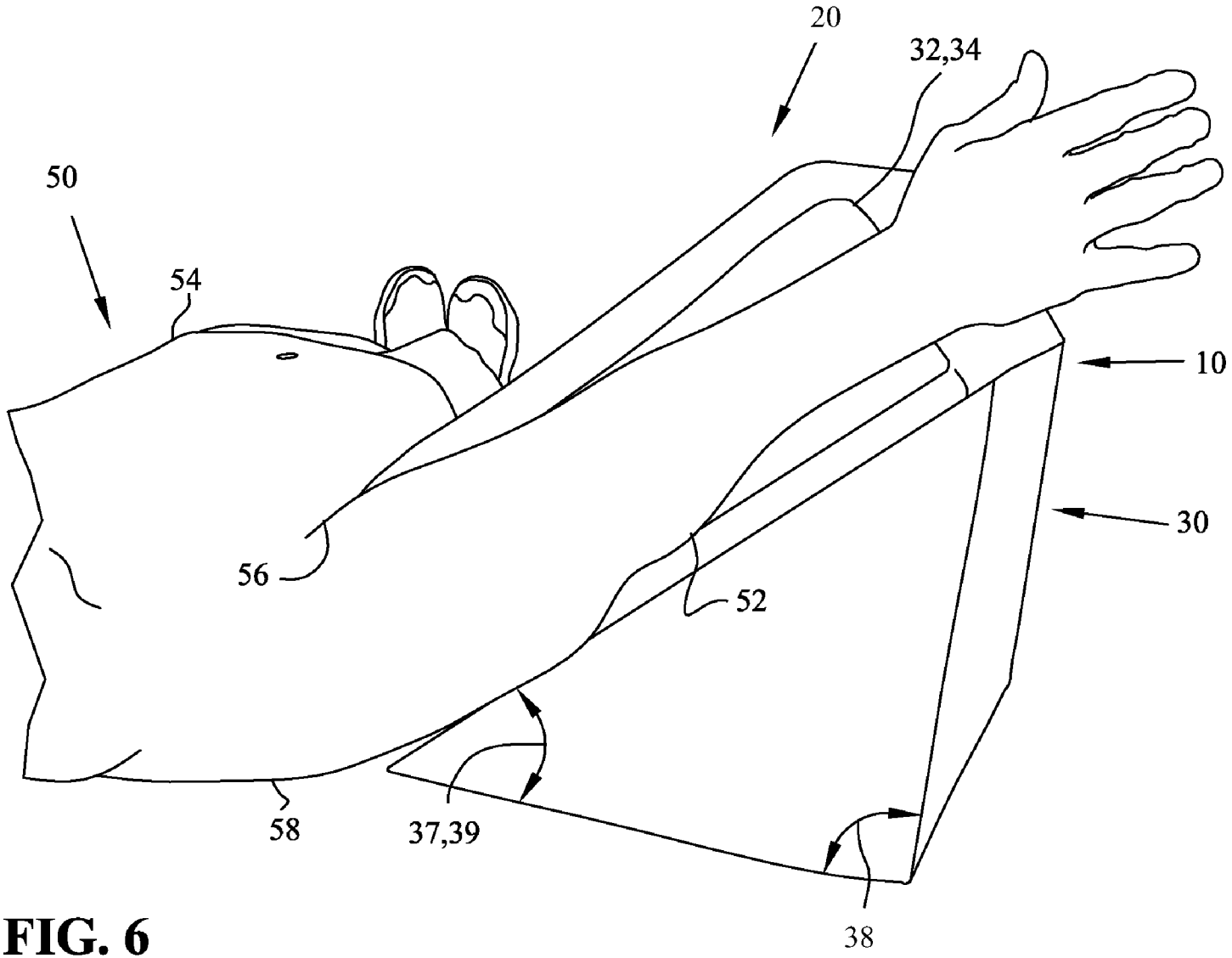
FIG. 6 is a side view of the upper extremity support of FIG. 1 in use.
Figure 8:
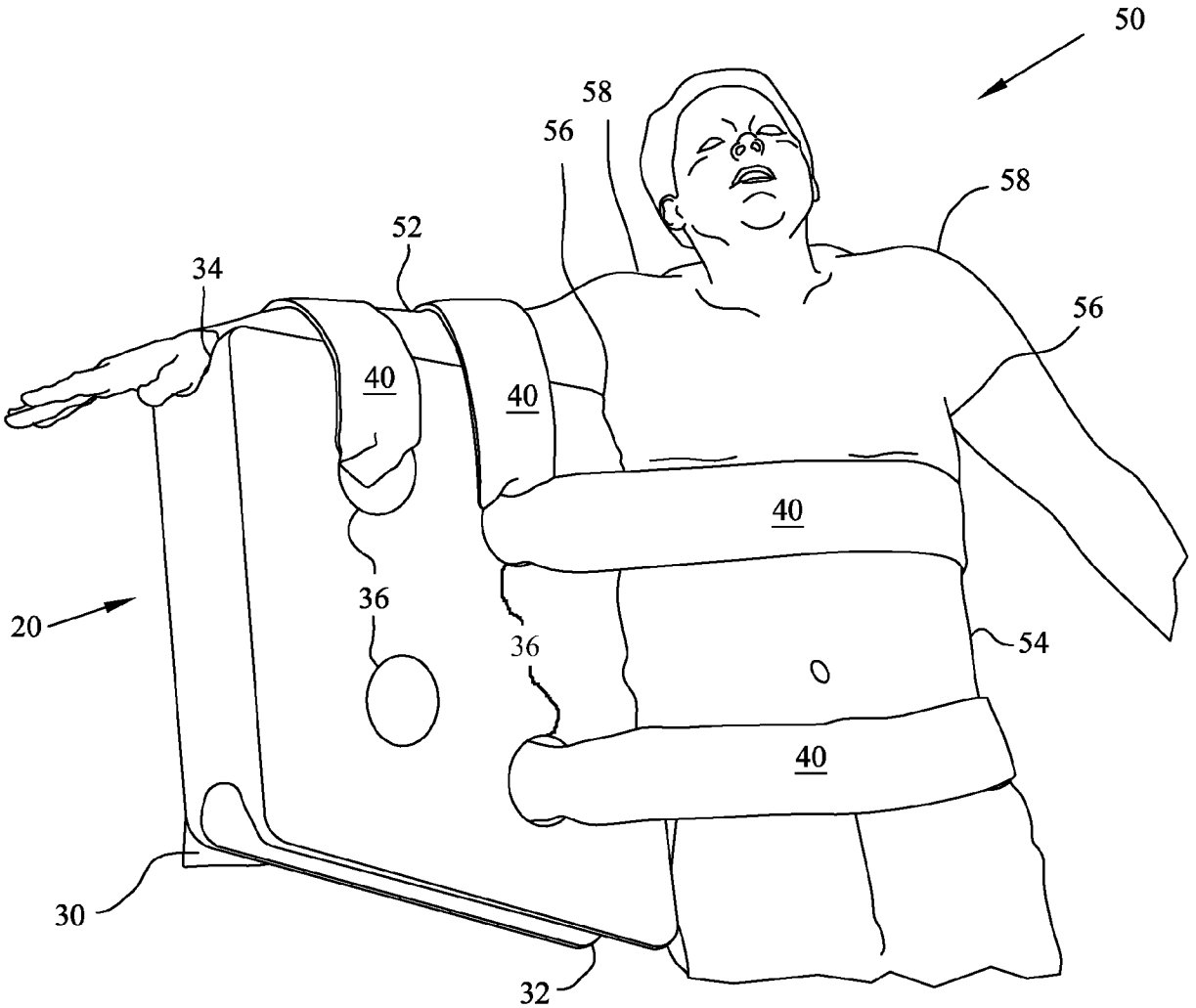
FIG. 8 is a top plan view of the upper extremity support of FIG. 7 in use showing additional straps coupled to the patient.

Wedge 20 may define grooves 32, 34 that receive an upper extremity as shown in FIGS. 6 and 8. As illustrated grooves 32 and 34 align with sides 23 and 27. Grooves 32 and 34 may include a substantially two (2) inch radius. For example, a pediatric application of wedge 20 may have at least one dimension including a substantially one (1) inch radius. In other embodiments, grooves 32 and 34 are not limited in position, orientation, or dimension.

Figure 7:
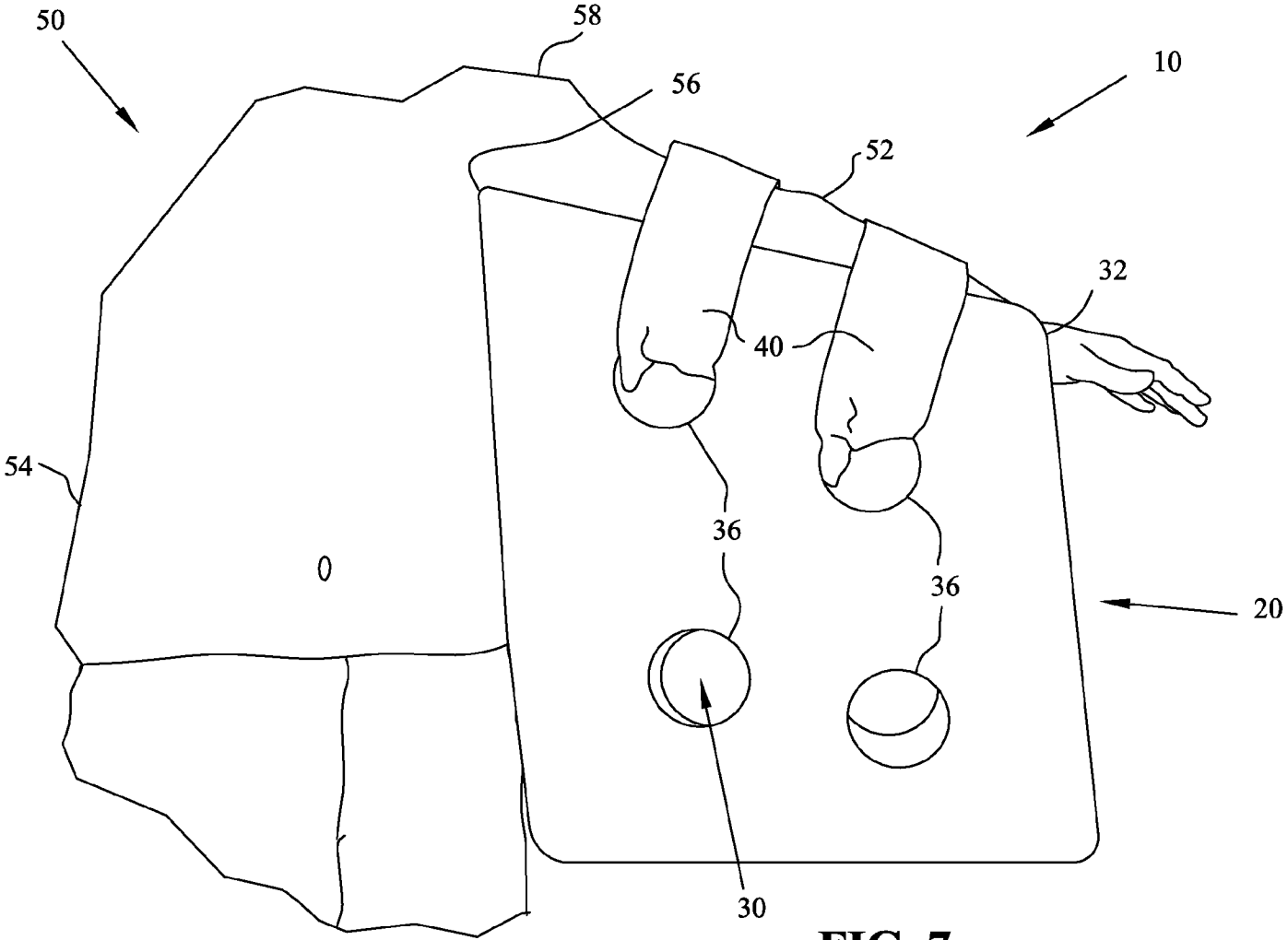
FIG. 7 is a top plan view of the upper extremity support of FIG. 1 showing the support coupled to the patient with straps.

As also illustrated in FIG. 1, wedge 20 defines apertures 36 that may receive straps 40 (FIG. 7). Apertures 36 may include a substantially two (2) inch radius. For example, a pediatric application of wedge 20 may include a substantially one (1) inch radius. In other embodiments, apertures 36 are not limited in position, orientation, or dimension.

During manufacturing, wedge 20 may be cut using cutting tools such as an electric knife. In the field or elsewhere, wedge 20 may be cut to adjust angles 22, 24, 26, 28. For example angle 26 may be cut to make angle 26 less than substantially 70°. Additionally, wedge 20 may be cut to accommodate splints.

In other embodiments, wedge 20 is not limited in size, shape, or dimension. Larger versions of wedge 20 are envisioned. Multiple wedges 20 may be used in conjunction.

As illustrated in FIG. 1, block 30 has a triangular cross section including angle 38. Angle 38 is illustrated as substantially 90°. Block 30 may be other shapes, such as prism, tetrahedron, pyramid, cone, sphere, or cylinder. As illustrated, block 30 also includes angles 37, 39 that are substantially 45 degrees. Angles 37, 39 may be other angles including any angle including and between substantially 0 and substantially 90 degrees.

Block 30 may be any structure which provides abduction and/or adduction of an upper extremity, such as horizontal adduction. Block 30 may also be any support to wedge 20 which provides abduction and/or adduction of an upper extremity, such as horizontal adduction.

Figure 1A:
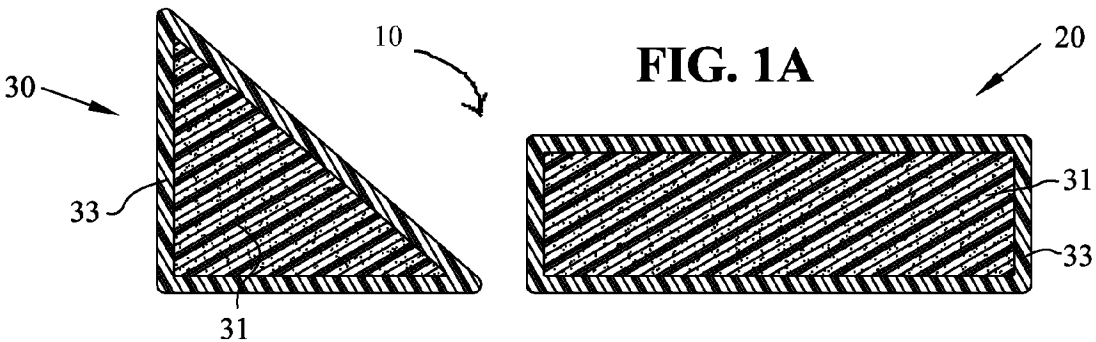
FIG. 1A is a cross sectional view of the upper extremity support of FIG. 1.

As illustrated in FIG. 1A, upper extremity support 10, wedge 20 and/or block 30 may be comprised of foam 31 and optionally coating 33. Foam 31 may comprise several forms, such as open cell foam. Foam may also include polyurethane foam, also known as foam rubber. In one embodiment, polyurethane foam is Foamex distributed by Foamex International, Inc. of Linwood, Pa. Coating 33 may comprise several forms, such as cured vinyl coating, polymers, such as polyethylenes, plastic, resins such as thermoplastic resins.

In one embodiment, coating 33 is known as AP1000 distributed by Atlantis Plastics of Mankato, Minn. AP1000 may include polyvinyl chloride, dodecyl sodium sulfate, polyester adipate, silicone dioxide, synthetic amorphous silica, acetic acid ethenyl ester, and/or paraffin waxes and hydrocarbon waxes. In this embodiment, coating 33 comprises a thin film produced from a blend of low density and linear low density polyethylenes. In this embodiment, coating 33 may include amorphous silica, cristobalite, flux-calcinated diatomaceous earth, crystalline silica, and/or erucyl amide up to 0.5% weight percentage.

Figure 2:
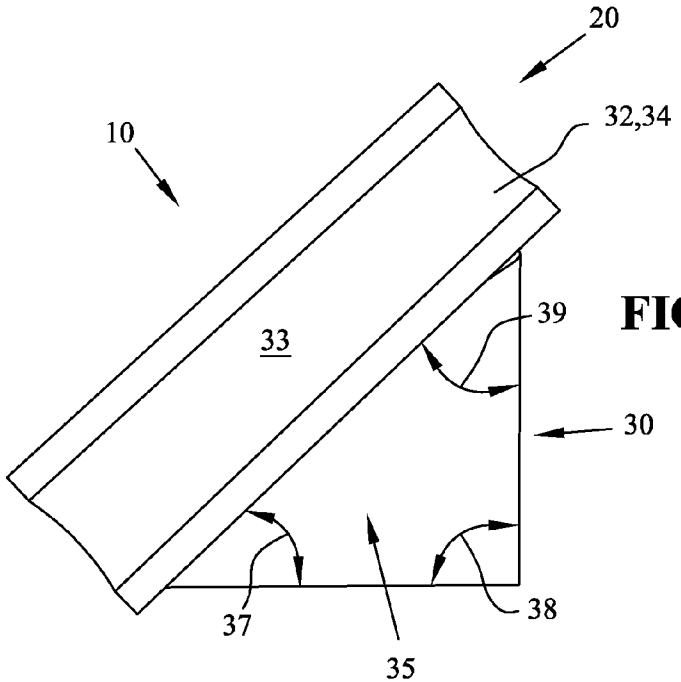
FIG. 2 is a side view of the upper extremity support of FIG. 1 showing the wedge and block in a first orientation.

As show in FIG. 2, block 30 supports wedge 20 at angle 37, illustratively substantially 45 degrees. Additionally block 30 may support wedge 20 at angle 39. Block 30 provides various degrees of abduction and horizontal adduction by positioning blocks with different angles 37, 39 under wedge 20 for various positions of skin and/or soft tissue stretch.

Block 30 also provides various degrees of abduction and horizontal adduction by adjusting angles 37, 39. As previously mentioned, angles 37, 39 may be other angles including any angle including and between substantially 0 and substantially 90 degrees. Therefore block 30 may support wedge 20 at any angle including and between substantially 0 and substantially 90 degrees.

Figure 3:
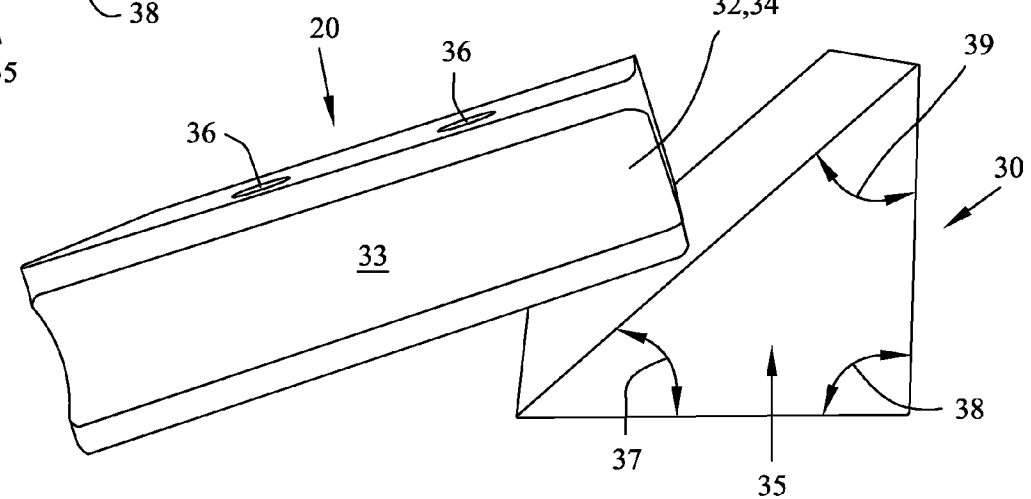
FIG. 3 is a side view of the upper extremity support of FIG. 1 showing the wedge and block in a second orientation.

As shown in FIG. 3, block 30 partially supports wedge 20, providing additional degrees of abduction and horizontal adduction. For example, wedge 20 may be moved back or forth in relation to block 30 to provide additional degrees of abduction and horizontal adduction. Alternatively block 30 may also provide further degrees of abduction and horizontal adduction by placing block 30 upon end 35. Block 30 may support wedge 20 in this fashion when patient is lying on their back, also known as a supine position. Block 30 may also support wedge 20 in this fashion when patient is standing and/or seated in a chair, such as a cardiac chair. Block 30 may also support wedge 20 in this fashion when patient is adjacent to a table, such as a tilt table. Block 30 may be placed on end 35 to provide support to wedge 20 at additional angles, such as substantially 0 degrees to substantially 180 degrees.

Figure 4:
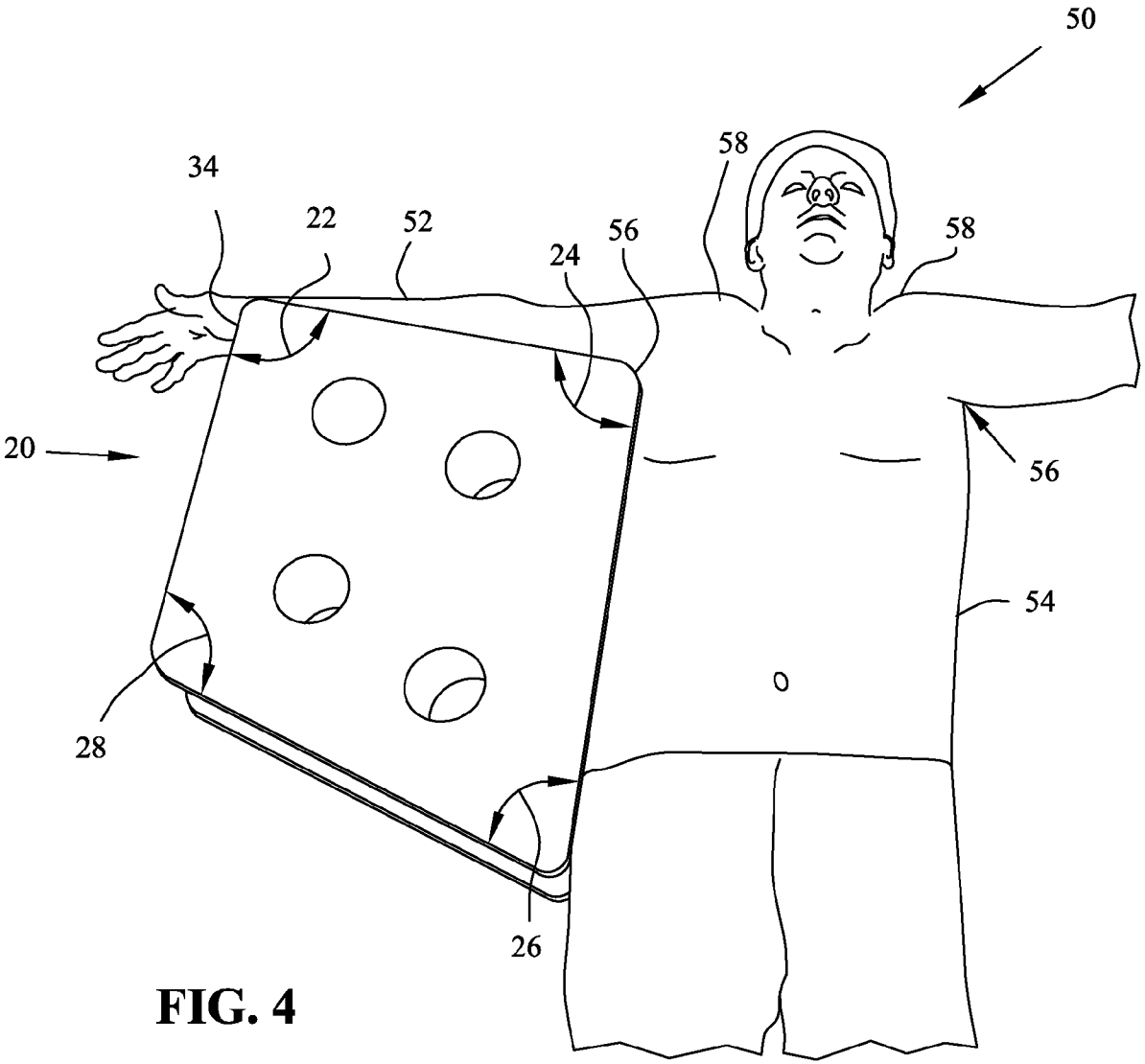
FIG. 4 is a top plan view of the wedge of FIG. 1 shown in use with a patient with the wedge in a first orientation.

As illustrated in FIG. 4, upper extremity support 10 is helpful for pre- and post-grafting or early post-injury to help preserve joint motion, and to positively influence scar tissue elongation and mobility. Upper extremity support 10 may be used to reduce swelling by keeping the arm elevated above the level of your heart. Upper extremity support 10 may also keep post burn skin around axilla 56 stretched.

Figure 5:
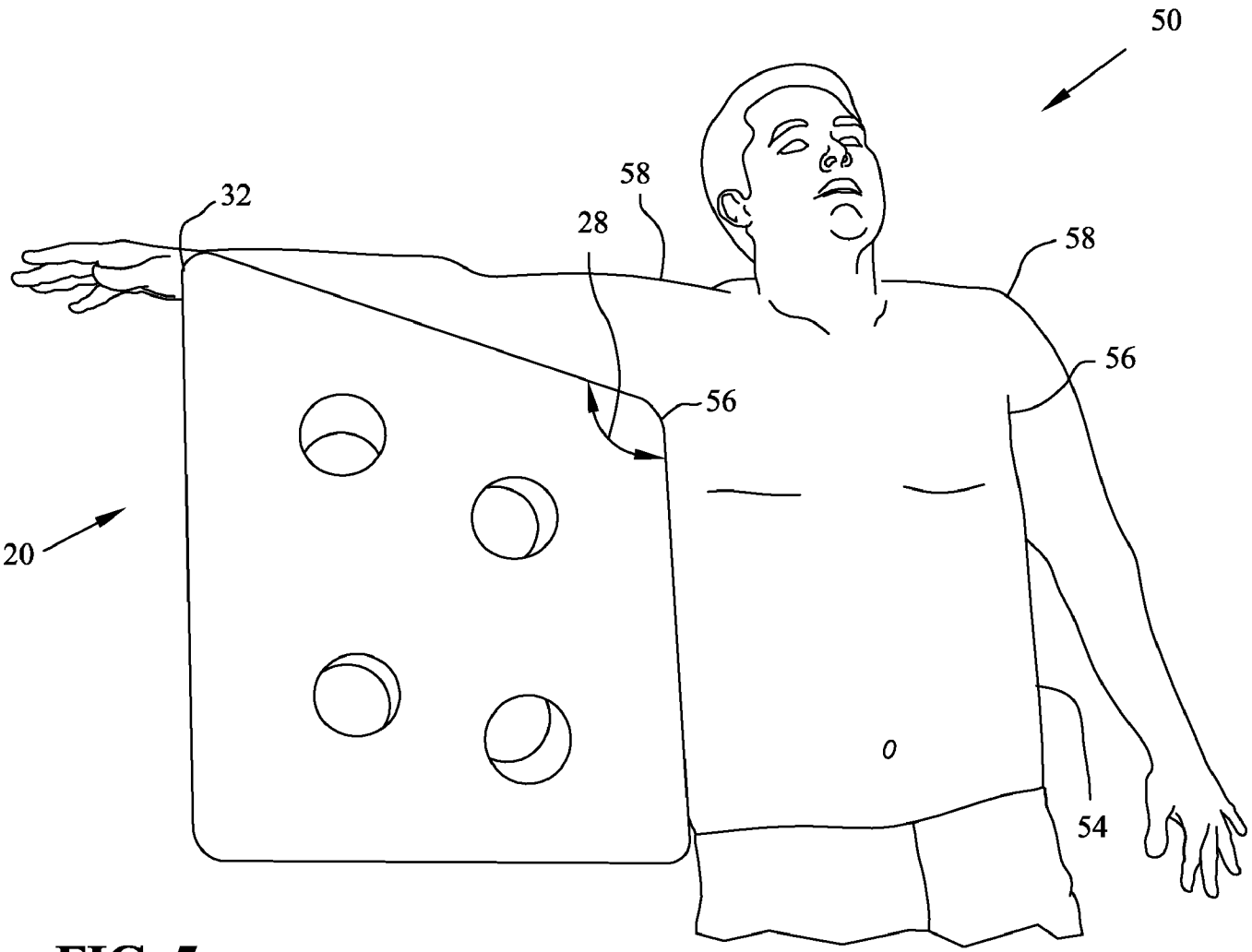
FIG. 5 is a top plan view of the wedge of FIG. 4 shown in use in a second orientation.

As shown in FIG. 4, wedge 20 is shown in use with patient 50. For example, wedge 20 may be placed between patient's upper extremity 52 and patient's torso 54. Patient's upper extremity 52 may be abducted to various degrees by any one of angles 22, 24, 26, and 28 of wedge 20. As shown, patient's upper extremity 52 is located within groove 34. Patient's upper extremity 52 could be located within either of grooves 32 and 34. As illustrated patient's arm 52 is abducted by angle 24. As shown in FIG. 5, wedge 20 is shown with patient's arm located within groove 32 and patient's arm abducted by angle 28.

As shown in FIG. 6, block 30 supports wedge 20 at angle 37 or 39. The patient's upper extremity 52 is abducted away from patient's torso 54 and also horizontally adducted towards the front of patient 50. When positioning patient 50 using block 30 fully positioned under wedge 20, the patient's upper extremity 52 may be positioned in a substantially scaption position, also known as the plane of the scapula. The plane of the scapula may put the patient's arm 52 in its most optimal position to minimize stress on shoulder 58 or axilla 56 while continuing to stretch the skin and tissue around shoulder 58 or axilla 56 to retain range of motion, reduce swelling and reduce functional impairment.

In operation, a care provider positions wedge 20 so that patient's upper extremity 52 is positioned at any of angles 22, 24, 26, or 28 to adduct patient's upper extremity 52 to any one of substantially 85, substantially 95, substantially 70 or substantially 110 degrees of abduction, respectively. For example, the choice of angle 22, 24, 26, or 28 depends on patient's 50 tolerance and/or burn intensity. Depending on the location of the burn and the desired tissue stretch, inserting block 30 under wedge 20 may achieve between about 0 and about 90 degrees of horizontal adduction. Horizontal adduction may be preferably between 15 and 45 degrees of horizontal adduction, most preferably 30 degrees.

A clean barrier, such as bandaging, liner, or external layer such as coating 33, could be placed between wedge 20 and the patient 50 or the patient's upper extremity 52 to allow a clean support environment. The clean barrier may be separate from or incorporated into wedge 20 or block 30. Wedge 20 or block 30 each may include features to aid in providing a clean support environment, such as a covering. Wedge 20 or block 30 each may also include a writeable surface upon which a care provide may write to indicate correct anatomical placement by other health workers.

As shown in FIG. 7, upper extremity support 10 may include straps 40 that retain upper extremity 52 to upper extremity support 10 and/or wedge 20, as well as other things. Straps 40, similar to upper extremity support 10, may include a clean barrier, such as bandaging, liner, or external layer such as coating 33 to allow a clean support environment. As illustrated, straps 40 wrap around patient's arm 52 retaining patient's arm 52 within groove 32. Straps 40 allow for support of patient's upper extremity 52 by wedge 20 or block 30. Straps 40 may help prevent antecubital fossa contractures, also known as deformation of the forearm.

Straps 40 may also allow for continual abduction of patient's upper extremity 52 with or without upper extremity adduction, such as by use of block 30. Straps 40 are not limited in width. In one embodiment, straps 40 are four (4) inches in width to disperse pressure on upper extremities 52. Straps 40 may provide for positioning patient's upper extremity 52 in supination, where the patient's palm is facing up, which is recommended per patient tolerance. Hook-and-loop type fasteners, such as Velcro brand hook-and-loop type fasteners, may be utilized to secure straps 40 upon themselves or to secure wedge 20 to block 30.

As shown in FIG. 8, straps 40 may aid in retaining patient's arm 52 within groove 34. Additionally straps 40 may aid in retaining patient's arm 52 within groove 32. Straps 40 may also be utilized to secure wedge 20 to torso 54 of patient 50. In operation straps 40 retain wedge 20 into axilla 56 of patient 50. As shown in FIG. 8, straps 40 may retain any of angles 22, 24, 26, 28 of wedge 20 into axilla 56 of patient 50.

Figure 9:
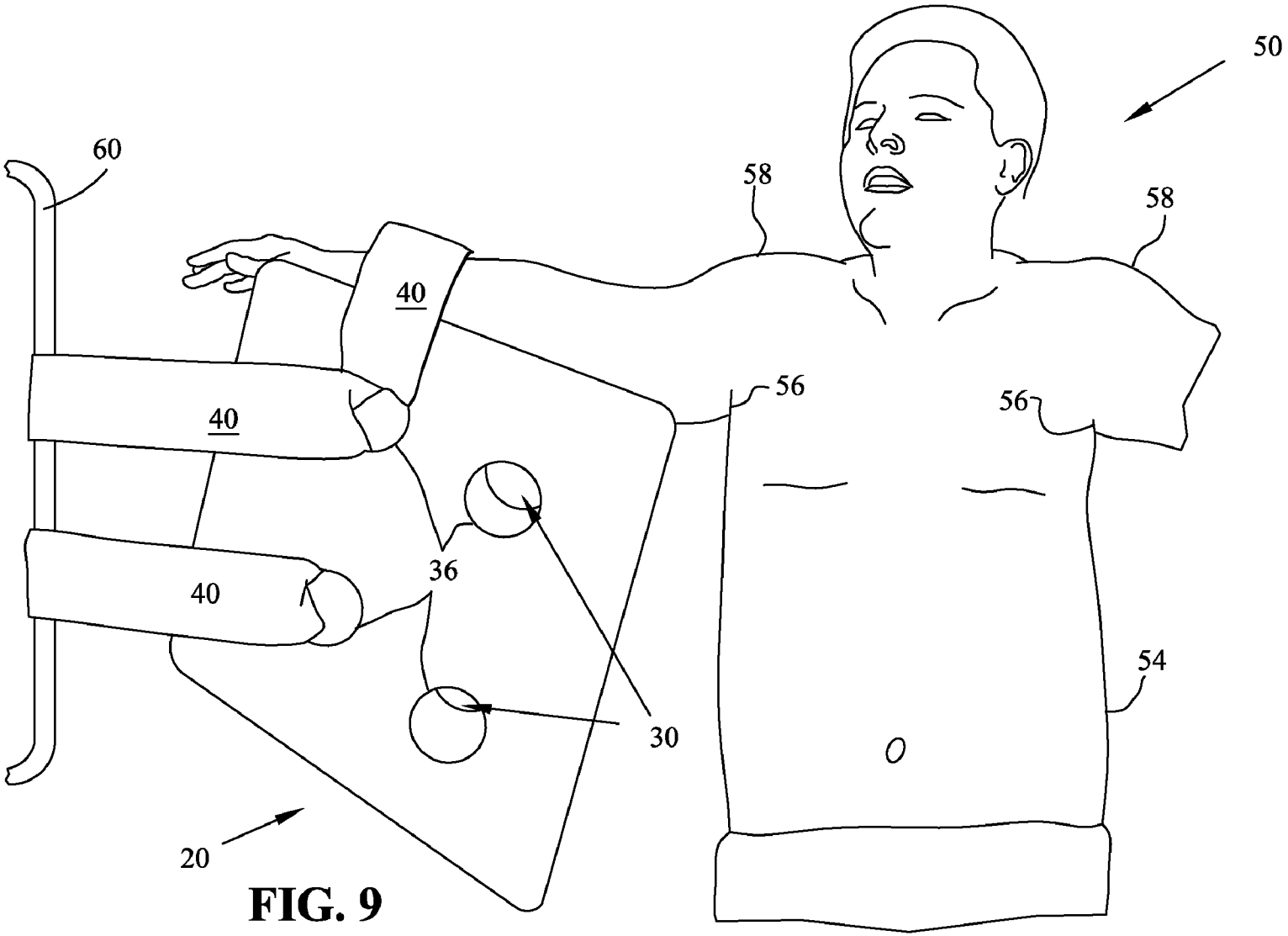
FIG. 9 is a top plan view of the upper extremity support of FIG. 7 in use showing the straps coupled to a support.

As shown in FIG. 9, wedge 20 may be fastened to support 60 by use of straps 40. Support 60 may be a rail of a bed, a chair, a table or any other support structure. Wedge 20 can also be fastened to a bedside table and used when patient 50 is either in bed or sitting in a chair. In FIG. 9, straps 40 are shown restraining wedge 20 away from patient 50. By fastening wedge 20 to support 60, wedge 20 may be kept away from torso 54 reducing shear on axilla and torso grafts on patient 50.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. An upper extremity support for use with an upper extremity of a patient lying on their back, where said upper extremity is abducted away from the torso of said patient, the support comprising:

a wedge substantially supporting the upper extremity, the wedge including foam providing cushion for the upper extremity, the wedge having a four sided polygon cross-sectional shape, each side of the four sided polygon cross-sectional shape defining an end, any two adjacent ends of the four ends defining an angle to abduct or adduct the upper extremity, one of the two adjacent ends defining a groove for positioning the upper extremity, a second end of the two adjacent ends defining a relatively flat surface, the second end in contact with the torso of said patient.

2. The arm support of claim 1 wherein the wedge defines a plurality of different angles of abduction and adduction.

3. The arm support of claim 1 wherein the wedge defines a plurality of grooves.

4. The arm support of claim 1 wherein the wedge defines an aperture.

5. The arm support of claim 4 further comprising a strap for fastening the upper extremity to the wedge, the strap being at least partially located in the aperture.

6. The arm support of claim 5 wherein the strap fastens the torso of the patient to the wedge.

7. An upper extremity support for use with an upper extremity of a patient lying on their back, where said upper extremity is abducted away from the torso of said patient, the support comprising:

a wedge substantially supporting the upper extremity, the wedge including foam providing cushion for the upper extremity, the wedge having a four sided polygon cross-sectional shape, each side of the four sided polygon cross-sectional shape defining an end, any two adjacent ends of the four ends defining an angle to abduct or adduct the upper extremity, one of the two adjacent ends defining a groove for positioning the upper extremity, a second end of the two adjacent ends defining a relatively flat surface, the second end in contact with the torso of said patient, and a block substantially supporting the wedge, the block including foam, the block having a triangular cross section, the triangular cross section defining three sides, any one of the three sides configured to support the wedge, the wedge at least partially stacked upon the block, the block positioning the wedge to horizontally adduct the upper extremity out of the plane of the torso of the patient.

8. The arm support of claim 7 wherein the block defines an angle of abduction or adduction.

9. The arm support of claim 8 wherein the wedge is supported at an angle between about 15 and at about 45 degrees from horizontal.

10. The support of claim 7 wherein the partially stacked wedge provides a plurality of angles of horizontal adduction out of the plane of the torso.

11. The arm support of claim 9 wherein the wedge is supported at an angle substantially about 30 degrees from horizontal.

12. The arm support of claim 9 wherein the wedge is supported substantially at the plane of the scapula.

13. A method of supporting an upper extremity of a patient comprising the steps of:

abducting the upper extremity away from the torso of the patient, and providing a wedge supporting the upper extremity, the wedge including foam providing cushion for the upper extremity, the wedge having a four sided polygon cross-sectional shape, each side of the four sided polygon cross-sectional shape defining an end, any two adjacent ends of the four ends defining an angle of abduction or adduction, one of the two adjacent ends defining a groove for positioning the upper extremity, second end of the two adjacent ends defining a relatively flat surface, the second end in contact with the torso of said patient.

14. The method of claim 13 further comprising the step of fastening the upper extremity to the wedge.

15. The method of claim 13 further comprising the step of fastening the wedge to a support.

16. The method of claim 13 further comprising the step of providing a block supporting the wedge, the block having a triangular cross section, the triangular cross section defining three sides, any one of the three sides configured to support the wedge, the wedge at least partially stacked up on the block, the block positioning the wedge to horizontally adduct the upper extremity out of the plane of the torso of the patient.

17. The method of claim 13 further comprising the step of supporting the upper extremity in a horizontal adduction position.

18. The method of claim 13 further comprising the step of fastening the upper extremity to the wedge.

19. The method of claim 13 further comprising the step of fastening the wedge to a support.

20. The method of claim 13 further comprising the step of supporting the upper extremity in a substantially scaption position.

* * * * *

UNITED STATES PATENT AND TRADEMARK OFFICE

CERTIFICATE OF CORRECTION

PATENT NO. : 7,640,610 B2
APPLICATION NO. : 12/180339
DATED : January 5, 2010
INVENTOR(S) : Perry Mervar It is certified that error appears in the above-identified patent and that said Letters Patent is hereby corrected as shown below:

Title Page, Item (73) Assignee: should read as follows, Assignee name: Lante Medical, Inc." should read --Lantz Medical, Inc.--
Title Page: Primary Examiner name: "Fredericki Conley," should read --Fredrick C. Conley--.

Signed and Sealed this

Sixteenth Day of February, 2010

David J. Kappos

David J. Kappos
*Director of the United States Patent and Trademark Office*